US008275273B2

(12) United States Patent
Thayer et al.

(10) Patent No.: US 8,275,273 B2
(45) Date of Patent: Sep. 25, 2012

(54) APPARATUS AND METHOD FOR EVALUATING PRINTING APPARATUS CLEANER PERFORMANCE

(75) Inventors: Bruce Earl Thayer, Spencerport, NY (US); Aaron Michael Burry, Ontario, NY (US); Michael D. Thompson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 303 days.

(21) Appl. No.: 12/822,736

(22) Filed: Jun. 24, 2010

(65) Prior Publication Data

US 2011/0318025 A1 Dec. 29, 2011

(51) Int. Cl.
*G03G 15/00* (2006.01)

(52) U.S. Cl. ..... 399/34; 399/49; 399/71; 399/72

(58) Field of Classification Search ..... 399/34, 399/49, 71, 72

See application file for complete search history.

(56) References Cited

U.S. PATENT DOCUMENTS

| | | | | |
|---|---|---|---|---|
| 5,264,904 | A | 11/1993 | Audi et al. | |
| 6,766,122 | B2 * | 7/2004 | Phillips et al. | 399/49 |
| 2004/0253014 | A1 * | 12/2004 | Bares | 399/49 |
| 2008/0008489 | A1 * | 1/2008 | Watanabe et al. | 399/71 |

* cited by examiner

*Primary Examiner* — Ryan Walsh
(74) *Attorney, Agent, or Firm* — Ronald E. Prass, Jr.; Prass LLP

(57) ABSTRACT

An apparatus (100) and method (200) that evaluates printing apparatus cleaner performance. The method can be performed in a printing apparatus that can include an intermediate transfer belt (150), an intermediate transfer belt sensor (155), a developer (115), a photoreceptor (110), and a photoreceptor cleaner (120). The method can include placing (220) marking material on the photoreceptor using the developer. The method can include cleaning (230) the marking material on the photoreceptor using the photoreceptor cleaner. The method can include transferring (240) the marking material to the intermediate transfer belt. The method can include sensing (250) marking material on the intermediate transfer belt using the intermediate transfer belt sensor.

38 Claims, 4 Drawing Sheets

APPARATUS AND METHOD FOR EVALUATING PRINTING APPARATUS CLEANER PERFORMANCE

BACKGROUND

Disclosed herein is an apparatus and method that evaluates printing apparatus cleaner performance.

Presently, image output devices, such as printers, multifunction media devices, xerographic machines, and other devices produce images on media sheets, such as paper, substrates, transparencies, plastic, cardboard, or other media sheets. To produce an image, a developer applies marking material, such as toner, ink jet ink, or other marking material, to a photoreceptor or other marking material image receiver. The marking material is then transferred from the photoreceptor to a media sheet to create an image on the media sheet.

A photoreceptor cleaner cleans toner, film, and other debris and material from the photoreceptor. Unfortunately, photoreceptor cleaners require adjustment or replacement as they age. Thus, the photoreceptor cleaners require maintenance at regular intervals to maintain consistent image quality on the media sheets. For example, some photoreceptor cleaners, such as cleaner blades, have a well known random failure mode. The time of failure and the location of failure along the length of the blade both have a distribution with long tails, which makes it very difficult to predict when and where a failure will occur. Most blades are capable of very long lives, but they are typically replaced well before failure in order to prevent an unscheduled failure if an individual blade happens to be one of the blades out on the early failure tail of the life distribution. Attempts have been made to predict blade life through algorithms based on monitoring blade stress conditions, such as low area coverage, environment, and/or job length. These methods have been somewhat successful in predicting average blade life but predictions for individual blades are still not particularly useful.

Thus, there is a need for an apparatus and method that evaluates printing apparatus cleaner performance.

SUMMARY

An apparatus and method that evaluates printing apparatus cleaner performance is disclosed. The method can be performed in a printing apparatus that can include an intermediate transfer belt, an intermediate transfer belt sensor, a developer, a photoreceptor, and a photoreceptor cleaner. The method can include placing marking material on the photoreceptor using the developer. The method can include cleaning the marking material. The method can include transferring marking material to the intermediate transfer belt. The method can include sensing the marking material on the intermediate transfer belt using the intermediate transfer belt sensor.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and do not limit its scope, the disclosure will be described and explained with additional specificity and detail through the use of the drawings in which.

DETAILED DESCRIPTION

Figure 1:
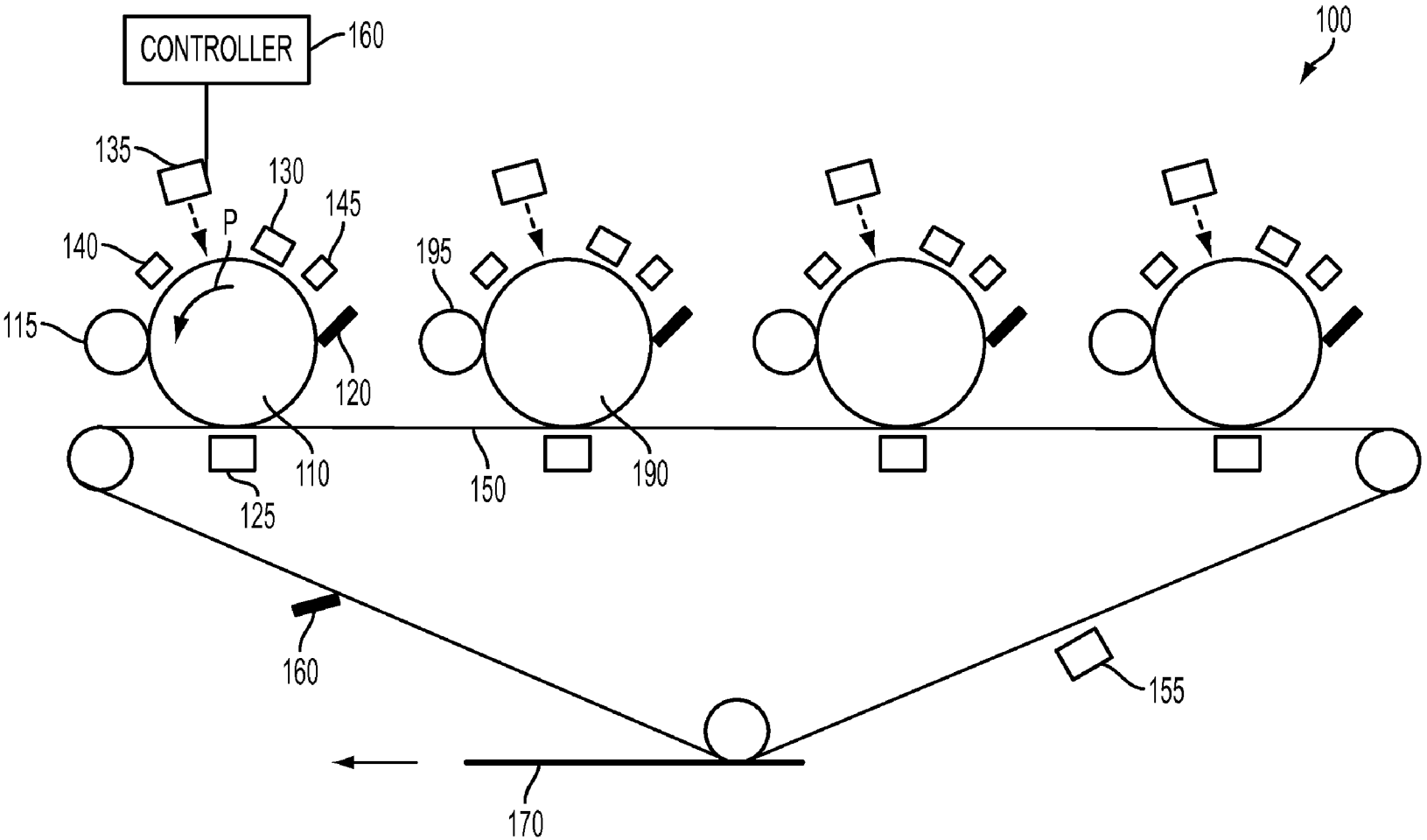
FIG. 1 is an exemplary illustration of a printing apparatus.

The embodiments include a method that evaluates printing apparatus cleaner performance that can include an intermediate transfer belt, an intermediate transfer belt sensor, a developer, a photoreceptor, and a photoreceptor cleaner. The method can include placing marking material on the photoreceptor using the developer. The method can include cleaning the marking material on the photoreceptor using the photoreceptor cleaner to produce residual marking material. The method can include transferring the residual marking material to the intermediate transfer belt. The method can include sensing the transferred marking material on the intermediate transfer belt using the intermediate transfer belt sensor.

The embodiments include a printing apparatus that evaluates printing apparatus cleaner performance. The printing apparatus can include a photoreceptor. The printing apparatus can include an intermediate transfer belt configured to receive marking material from the photoreceptor. The printing apparatus can include a developer configured to place marking material on the photoreceptor. The printing apparatus can include a photoreceptor cleaner configured to clean the marking material on the photoreceptor to produce residual marking material. The printing apparatus can include a transfer station configured to transfer the residual marking material to the intermediate transfer belt. The printing apparatus can include an intermediate transfer belt sensor configured to sense the transferred marking material on the intermediate transfer belt.

The embodiments further include a method that evaluates printing apparatus cleaner performance in a printing apparatus that can have an intermediate transfer belt, an intermediate transfer belt sensor, a developer, a photoreceptor, and a photoreceptor cleaner. The method can include placing marking material on the photoreceptor using the developer. The method can include substantially disabling transfer of the marking material from the photoreceptor to the intermediate transfer belt after placing the marking material on the photoreceptor. The method can include rotating the photoreceptor in a process direction to move the marking material on the photoreceptor past the intermediate transfer belt after disabling transfer of the marking material from the photoreceptor to the intermediate transfer belt. The method can include cleaning the marking material on the photoreceptor using the photoreceptor cleaner, after moving the marking material on the photoreceptor past the intermediate transfer belt, to produce residual marking material. The method can include transferring the residual marking material to the intermediate transfer belt. The method can include sensing the transferred marking material on the intermediate transfer belt using the intermediate transfer belt sensor.

The embodiments further include a method that evaluates printing apparatus cleaner performance. The printing apparatus can have a photoreceptor, an intermediate transfer belt, an intermediate transfer belt cleaner, and an intermediate transfer belt sensor. The method can include placing marking material on the photoreceptor. The method can include transferring the marking material from the photoreceptor to the intermediate transfer belt to produce transferred marking material on the intermediate transfer belt. The method can include substantially disabling transfer of the transferred marking material from the intermediate transfer belt after transferring the marking material from the photoreceptor to the intermediate transfer belt and before cleaning the transferred marking material on the intermediate transfer belt. The method can include cleaning the transferred marking material on the intermediate transfer belt using the intermediate transfer belt cleaner to produce residual marking material on the intermediate transfer belt. The method can include sensing the residual marking material on the intermediate transfer belt using the intermediate transfer belt sensor.

The embodiments include a printing apparatus that evaluates printing apparatus cleaner performance. The printing apparatus can include a photoreceptor. The printing apparatus can include a developer configured to place marking material on the photoreceptor. The printing apparatus can include an intermediate transfer belt configured to receive marking material transferred from the photoreceptor. The printing apparatus can include an intermediate transfer belt cleaner configured to clean the transferred marking material on the intermediate transfer belt using the intermediate transfer belt cleaner to produce residual marking material on the intermediate transfer belt. The printing apparatus can include a media transfer station configured to transfer marking material from the intermediate transfer belt to media. The printing apparatus can include a controller configured to substantially disable transfer of the transferred marking material from the intermediate transfer belt after transferring the marking material from the photoreceptor to the intermediate transfer belt and before cleaning the transferred marking material on the intermediate transfer belt. The printing apparatus can include an intermediate transfer belt sensor configured to sense the residual marking material on the intermediate transfer belt.

FIG. 1 is an exemplary illustration of a printing apparatus 100. The printing apparatus 100 may be a printer, a multifunction media device, a xerographic machine, a laser printer, an ink jet printer, or any other device that generates an image on media. The printing apparatus 100 can include a photoreceptor 110. The photoreceptor 110 can be a belt or drum and can receive electrostatic images.

The printing apparatus 100 can include a charge device 130, such as a scorotron, a charge roll, or any other electric field generation device. During normal print operation, the charge device 130 can apply a voltage to a photoreceptor 110. For example, the charge device 130 can charge the photoreceptor 110 surface by imparting an electrostatic charge on the surface of the photoreceptor 110 as the photoreceptor 110 rotates. The printing apparatus 100 can include an exposer 135, such as a laser source, a Light Emitting Diode (LED) bar, a raster output scanner, or other relevant device. The exposer 135 can discharge selected portions of the photoreceptor 110 in a configuration corresponding to the desired image to be printed.

The printing apparatus 100 can include a developer 115. The developer 115 can develop an exposed latent image by applying a voltage bias to create an electric field between the developer 115 and the photoreceptor 110 after certain areas of the photoreceptor 110 are discharged by the exposer 135. The developer 115 can cause a supply of marking material, such as dry toner, to contact or otherwise approach the exposed latent image on the surface of the photoreceptor 110. The printing apparatus 100 can include a transfer station 125 and an intermediate transfer belt 150. The transfer station 125 can cause marking material, such as the toner, adhering to the photoreceptor 110 to be transferred to the intermediate transfer belt 150 to form the image thereon. The intermediate transfer belt can then transfer the image to media 170, such as paper, plastic, labels, or other media. The printing apparatus 100 can include a photoreceptor cleaner 120. The photoreceptor cleaner 120 can include one or more or combinations of a cleaning blade, an electrostatic brush cleaner, a magnetic brush cleaner, a foam roll cleaner, an air knife, or other photoreceptor cleaners. The photoreceptor cleaner 120 can clean marking material and other material from the photoreceptor 110.

The printing apparatus 100 can include a printing apparatus controller 160 configured to control operations of the printing apparatus 100. The printing apparatus controller 160 can be coupled to the exposer 135, the developer 115, the transfer station 125, the charge device 130, and some or all of the other elements of the printing apparatus 100. The printing apparatus 100 can include an electrostatic volt meter 140 that can measure a voltage potential on the photoreceptor 110. The printing apparatus 100 can include an eraser 145. The eraser 145 can be a light emitting diode bar, a light emitting diode array, an erase lamp, or other device that can project light onto the photoreceptor 110.

The printing apparatus 100 can include one photoreceptor 110 or can include at least one second photoreceptor 190. Other elements, such as a second developer 195, can also be included with the second photoreceptor 190. For example, the printing apparatus 100 can include a plurality of photoreceptors, where each photoreceptor can provide a different color marking material, can provide black marking material, can produce a clear coat marking material, or can otherwise produce marking material onto an intermediate transfer belt to produce images on media.

The printing apparatus 100 can include an intermediate transfer belt sensor 155. The intermediate transfer belt sensor 155 can sense marking material or other information on the intermediate transfer belt 150. The printing apparatus 100 can include an intermediate transfer belt cleaner 160, such as a cleaning blade, a cleaning brush, or other device that can clean marking material or other material off the intermediate transfer belt 150.

In an operation of evaluating printing apparatus cleaner performance, the developer 115 can place marking material on the photoreceptor 110. For example, the developer 115 can develop a marking material cleaning stress patch on the photoreceptor 110. Although stress patches are shown in some embodiments as test images having a property of stressing the cleaning system in a predetermined desired manner, there may be other reasons or types of images or marking material used for evaluating photoreceptor cleaner performance. For example, cleaner performance can be evaluated using grayscale images, using color images, using images intended for printing, using specific or generic marking material patterns, or using any other marking material. The photoreceptor cleaner 120 can clean the marking material cleaning stress patch on the photoreceptor 110 to produce a residual marking material cleaning stress patch. The transfer station 125 can transfer the residual marking material cleaning stress patch to the intermediate transfer belt 150. The intermediate transfer belt sensor 155 can sense the transferred marking material cleaning stress patch on the intermediate transfer belt 150.

Embodiments can sense effectiveness of the photoreceptor cleaner 120 and can adjust operation or replace components of the photoreceptor cleaner 120. For example, the photoreceptor 110 can rotate in a process direction P to move the marking material cleaning stress patch on the photoreceptor 110 past the intermediate transfer belt 150 after the marking material cleaning stress patch is developed on the photoreceptor 110. The photoreceptor cleaner 120 can clean the marking material cleaning stress patch on the photoreceptor 110 after the marking material cleaning stress patch on the photoreceptor 110 is moved past the intermediate transfer belt 150. The transfer station 125 can transfer the residual marking material cleaning stress patch after the photoreceptor cleaner 120 cleans the marking material cleaning stress patch on the photoreceptor 110. During normal print operation, the transfer station 125 transfers images from the photoreceptor 110 to the intermediate transfer belt 150 and the photoreceptor cleaner 120 cleans residual marking material left after an image is transferred to the intermediate transfer belt 150. During a diagnostic cycle, first transfer of an image from the photoreceptor 110 to the intermediate transfer belt 150 can be reduced and/or disabled to allow the photoreceptor cleaner 120 to clean the full image and allow the intermediate transfer belt sensor 155 to measure the effectiveness of the photoreceptor cleaner 120. For example, the printing apparatus controller 160 can substantially disable transfer of the marking material stress patch from the photoreceptor 110 to the intermediate transfer belt 150 after the developer 115 develops the marking material cleaning stress patch on the photoreceptor 110 and before the photoreceptor cleaner 120 cleans the marking material cleaning stress patch on the photoreceptor 110. The printing apparatus controller 160 can minimize interaction with the residual marking material cleaning stress patch prior to transferring the residual marking material cleaning stress patch to the intermediate transfer belt 150. Such interaction can include development and scavenging of the patch and other interaction with the patch. Scavenging and/or development of the patch can also be minimized in additional ways. For example, a camming mechanism (not shown) can be used to move the developer 115 away from the photoreceptor 110. Also, the charge device 130 can charge the photoreceptor 110 and the printing apparatus controller 160 can substantially disable charging the photoreceptor 110 while the residual marking material cleaning stress patch passes under the charge device 130 and disable development on the photoreceptor 110 prior to transferring the residual marking material cleaning stress patch to the intermediate transfer belt 150. For example, the charge device 130, such as a scorotron, a corotron, a bias charging roll, or another charge device, can charge the photoreceptor 110 and the charge device 130 can be disabled as the residual marking material cleaning stress patch passes under the charge device 130 after the photoreceptor cleaner 120 cleans the marking material cleaning stress patch on the photoreceptor 110.

The photoreceptor 110 can be a first photoreceptor and the developer 115 can be a first developer configured to develop a first marking material cleaning stress patch on the first photoreceptor. The printing apparatus 100 can include a second photoreceptor 190 and a second developer 195 configured to develop a second marking material cleaning stress patch on the second photoreceptor 190.

The printing apparatus controller 160 can determine the transferred marking material cleaning stress patch on the intermediate transfer belt 150 has an amount of transferred marking material greater than a threshold amount of marking material based on the intermediate transfer belt sensor 155 sensing the transferred marking material cleaning stress patch. The printing apparatus controller 160 can output a signal indicating that the photoreceptor cleaner 120 will require adjustment if the amount of transferred marking material on the intermediate transfer belt 150 is greater than the threshold amount of marking material. Adjustment can include photoreceptor cleaner and/or photoreceptor cleaner part replacement, photoreceptor cleaner maintenance, adjustment of air flow, adjustment of bias, brush cleaning, blade replacement, or other adjustments to the photoreceptor cleaner 120. Additionally, the signal can indicate the photoreceptor cleaner 120 will require adjustment by calling for immediate replacement of the photoreceptor cleaner 120, by predicting a future end of life for the photoreceptor cleaner 120, or can otherwise be used to indicate the photoreceptor cleaner 120 will require adjustment.

For purposes of illustration, the following embodiments describe operation with respect to a photoreceptor cleaning blade, an optical array sensor, toner, and other elements. However, the embodiments can also be applied to other photoreceptor cleaners, other sensors, other marking material, and other elements. According to some embodiments, photoreceptor blade cleaning failures can be detected by sending a stress patch of marking material, such as toner, into the photoreceptor cleaning blade to provide the largest possible failure signal. The toner that passes under the blade can be read by an optical array sensor to determine whether or not the blade is performing as expected. A single optical array sensor 155 can be located on the intermediate belt 150 to avoid the cost and space of a sensor on each photoreceptor drum 110. To enable the blade stress patch to reach the optical array sensor 155, a special blade test cycle can be run, where transfer from the photoreceptor 110 to the intermediate transfer belt 150 is disabled to allow the stress patch to reach the blade. Charge and development can then be disabled to allow the cleaned stress patch to pass the charge device 130 and the developer 115. The stress patch can then be transferred to the intermediate transfer belt 150. The stress patches can be the full width of the blade and can be relatively narrow in the photoreceptor process rotation direction P. By timing development of the patches, blades of all colors can be tested within a single document panel and the printing process can be interrupted for only a single print at relatively infrequent intervals. Alternately, the patches can be tested in inter-document zones to avoid interruption or can be tested in other areas.

In a printing operation using multiple photoreceptors, each color can be developed onto its photoreceptor drum and transferred to the intermediate transfer belt 150. The image can then pass under an optical array sensor 155 where it can be optically, electrically or otherwise sensed. The sensed image can then be evaluated by controller software and, if required, corrections to the printing process can be made.

When using a sensor to evaluate the cleaning function of an intermediate transfer belt cleaner 160, such as an intermediate transfer belt cleaning blade, a stress toner patch can be developed onto one of the photoreceptor drums, such as a photoreceptor drum for black or cyan toner. The stress toner patch can extend the full width of the intermediate transfer belt cleaning blade 160 or the largest development width, and can be 10 mm to 30 mm or otherwise wide in the process direction. The patch can be developed at the highest density to provide the highest cleaning stress to the blade. Transfer to the media sheet 170 can be inhibited by preventing paper from being fed and by not energizing a transfer charge device in a media transfer station (not shown) as the patch travels through the media transfer station. The intermediate transfer belt blade 160 can clean the stress cleaning patch and any toner not removed by the blade 160 passes under the blade 160. First transfers from the photoreceptors, such as the photoreceptors 110 and 190, can be inhibited so that the stress cleaning patch residual toner passes through with a minimum amount of disturbance. The sensor 155 can then read the intermediate transfer belt surface in the location where the stress cleaning patch was to see how much toner remains from the original patch. Cleaning acceptability limits can be established for the particular print process system and product goals. If the amount of toner observed by the sensor 155 exceeds the acceptability limit, then a fault can be declared and the blade 160 can be replaced in order to produce defect free prints. Toner leakage past a cleaning blade 160 can occur at a level that does not cause print defects well before defects are observable on prints. Sensing of these pre-defect levels of toner on the intermediate belt 150 can provide information on the wear state of the cleaning blade 160 and can provide an early warning of impending failures. This information can be used to schedule preventative replacement of the cleaning blade 160 and can avoid an unscheduled maintenance call that makes the printing apparatus 100 unavailable to the customer. Development and evaluation of cleaning stress patches can be performed while the printing apparatus 100 is in between printing jobs, during cycle-up, during cycle-down, or otherwise performed. For example, the blade function evaluation can also be performed in the middle of a printing job by skipping a printing pitch to allow the patches to pass through the system without media sheets.

The cleaning function of the photoreceptor cleaner 120, such as a photoreceptor cleaning blade, can be evaluated by the sensor 155 in a similar manner. In this case the cleaning stress patches can be developed on each photoreceptor drum but not transferred to the intermediate belt 150. The blade 120 can clean the stress patch and the cleaning residual can pass under erase 145. Photoreceptor charge 130 can be disabled, exposure 135 can be disabled, and the residual cleaning stress patch can continue under the electrostatic volt meter 140. At the electrostatic volt meter 140, the photoreceptor surface potential just prior to the cleaning stress patch, such as the background, and the photoreceptor surface potential within the cleaning stress patch can be measured. The development AC bias can be disabled and the DC bias can be set to the average of the stress patch potential and the potential outside of the stress patch. These changes to development can minimize the interaction, such as marking material development, scavenging, or carrier bead development, of the development system with the cleaning stress patch. As the cleaning stress patch completes its cycle around the photoreceptor 110, the patch can be transferred to the intermediate belt 150. Development of cleaning stress patches in all colors can be done so that the residuals from each color stress patch can be transferred within a single print panel on the intermediate belt 150 and the patches can be separated from each other. The sensor 155 can then read all the patches and evaluations of the conditions of the blades can be made by the controller 160.

Embodiments can increase blade life and reliability which can reduce run cost of a printing apparatus. Embodiments can also reduce unscheduled maintenance actions due to blade failures, which can increase printing apparatus availability. Embodiments can utilize a single sensor located on an intermediate transfer belt to monitor the cleaning function of all blades in a tandem system. Embodiments can be used in color printers, black and white printers, high speed production machines, single photoreceptor printers, multiple photoreceptor printers, and other printing devices. Embodiments can allow the use of a single sensor on an intermediate belt to replace sensors on each of multiple photoreceptor drums.

Figure 2:
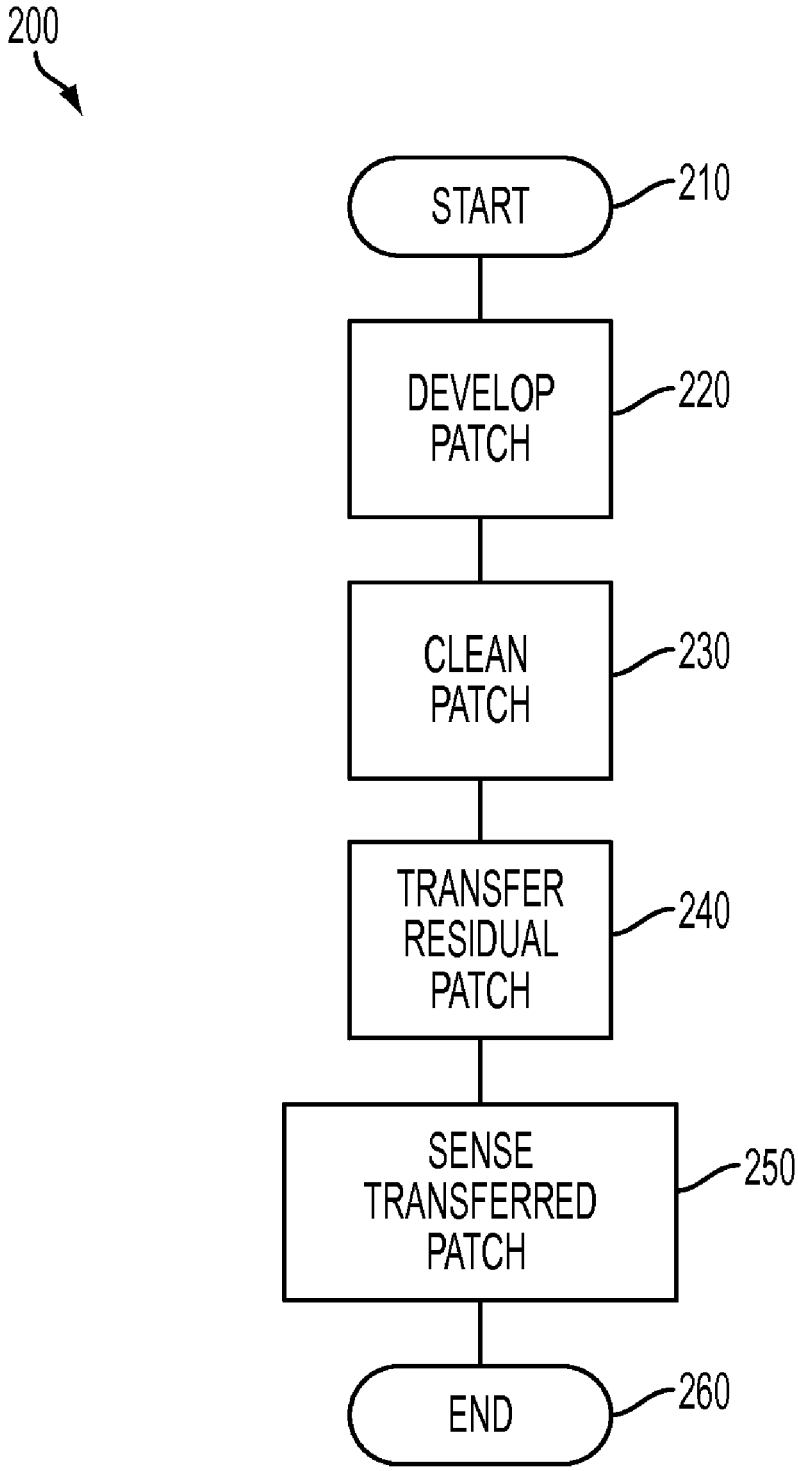
FIG. 2 illustrates an exemplary flowchart of a method that evaluates printing apparatus cleaner performance.

FIG. 2 illustrates an exemplary flowchart 200 of a method that evaluates printing apparatus cleaner performance in a printing apparatus, such as the printing apparatus 100. The printing apparatus can have a photoreceptor, a developer, a photoreceptor cleaner, an intermediate transfer belt, and an intermediate transfer belt sensor. The method starts at 210. At 220, marking material can be placed on the photoreceptor using the developer. For example, a marking material cleaning stress patch can be developed on the photoreceptor using the developer. At 230, the marking material cleaning stress patch on the photoreceptor can be cleaned using the photoreceptor cleaner to produce a residual marking material cleaning stress patch. At 240, the residual marking material cleaning stress patch can be transferred to the intermediate transfer belt. At 250, the transferred marking material cleaning stress patch on the intermediate transfer belt can be sensed using the intermediate transfer belt sensor. At 260, the method ends. The flowchart 200 or blocks of the flowchart 200 may be performed numerous times, such as iteratively. For example, the flowchart 200 may loop back from later blocks to earlier blocks. Furthermore, many of the blocks can be performed concurrently or in parallel processes.

Figure 3:
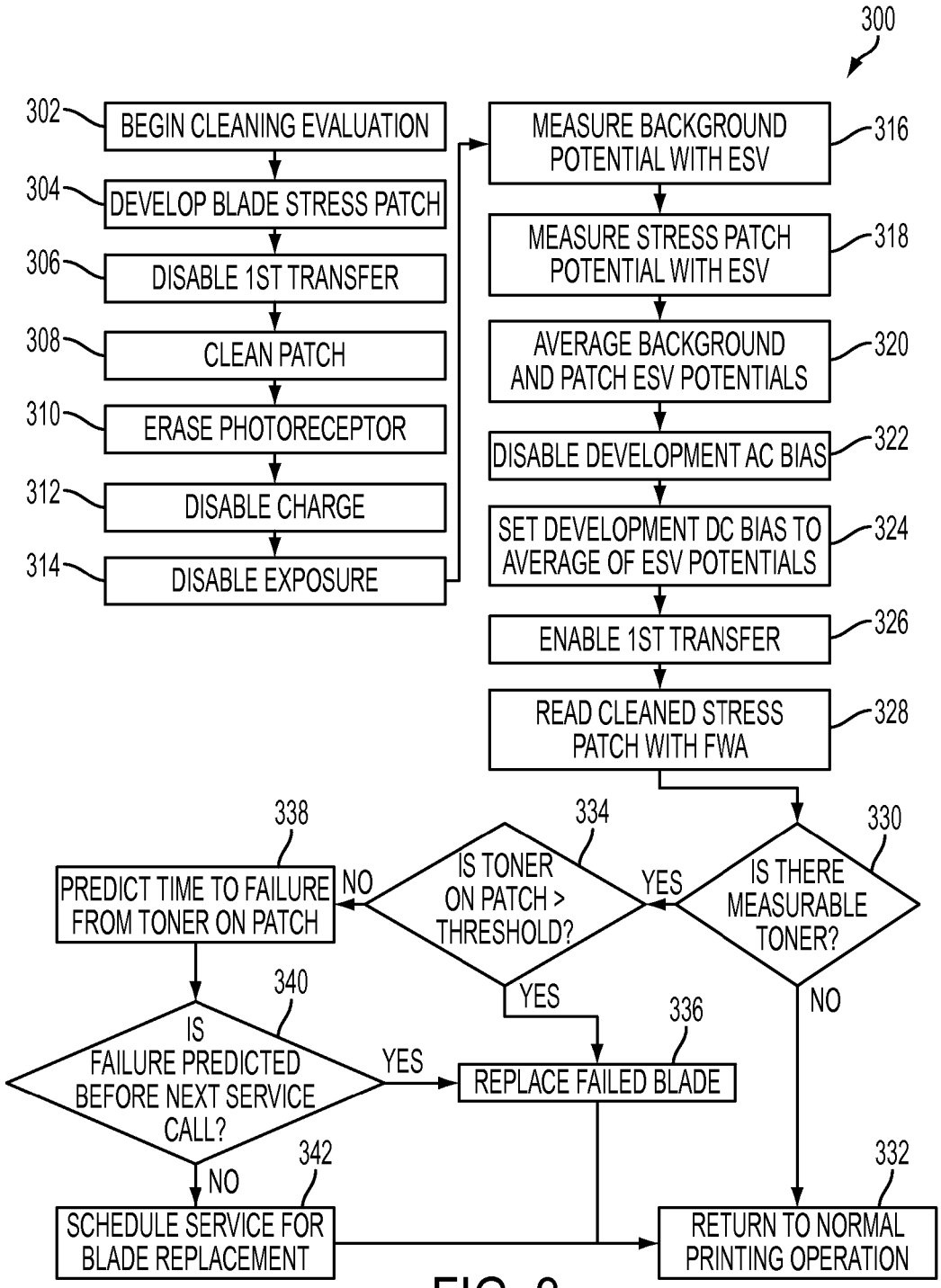
FIG. 3 illustrates an exemplary flowchart of a method that evaluates printing apparatus cleaner performance.

FIG. 3 illustrates an exemplary flowchart 300 of a method that evaluates printing apparatus cleaner performance in a printing apparatus, such as the printing apparatus 100. Elements of the flowchart 300 can be used with elements of the flowchart 200. Cleaning evaluation begins at 302. At 304, a marking material cleaning stress patch can be developed on a photoreceptor. One or more cleaning stress patches can be developed on one or more photoreceptors. For example, a first marking material cleaning stress patch can be developed on a first photoreceptor and a second marking material cleaning stress patch can be developed on a second photoreceptor. The first marking material cleaning stress patch can be of a first color and the second marking material cleaning stress patch can be of a second color different from the first color.

At 306, transfer of the marking material cleaning stress patch from the photoreceptor to an intermediate transfer belt can be disabled. For example, transfer of the marking material stress patch from the photoreceptor to the intermediate transfer belt can be substantially disabled after developing a marking material cleaning stress patch on the photoreceptor and before cleaning the marking material cleaning stress patch on the photoreceptor. As a further example, the photoreceptor can rotate in a process direction to move the marking material cleaning stress patch on the photoreceptor past the intermediate transfer belt after the marking material cleaning stress patch is developed on the photoreceptor.

At 308, the marking material cleaning stress patch can be cleaned using a photoreceptor cleaner to produce a residual marking material cleaning stress patch. For example, the marking material cleaning stress patch on the photoreceptor can be cleaned after the marking material cleaning stress patch on the photoreceptor is moved past the intermediate transfer belt. At 310, the photoreceptor can be erased using an eraser. At 312, charging of a charge device can be disabled. For example, charging the photoreceptor can be disabled while the residual marking material cleaning stress patch passes under the charge device. At 314, exposure of an exposer can be disabled.

At 316, a background potential can be measured using an electrostatic volt meter. At 318, a residual marking material cleaning stress patch potential can be measured using an electrostatic volt meter. For example, a voltage on the photoreceptor can be sensed after cleaning the marking material cleaning stress patch. At 320, the average potential of the background potential and the residual marking material cleaning stress patch potential can be determined. At 322, a developer alternating current bias can be disabled. For example, a development alternating current bias can be substantially disabled as the residual marking material cleaning stress patch passes under the developer. As a further example, development on the photoreceptor can be disabled prior to transferring the residual marking material cleaning stress patch from the photoreceptor to the intermediate transfer belt. At 324, a developer direct current bias can be set to the average potential of the background potential and the residual marking material cleaning stress patch potential. For example, a development direct current bias can be set to minimize development of the residual marking material cleaning stress patch. As a further example, a development direct current bias can be set to substantially an average of a background potential on the photoreceptor and a residual marking material cleaning stress patch potential on the photoreceptor as the residual marking material cleaning stress patch passes under the developer.

Thus, after block 308, interaction with the residual marking material cleaning stress patch can be minimized prior to transferring the residual marking material cleaning stress patch to the intermediate transfer belt.

At 326, transfer of the residual marking material cleaning stress patch from the photoreceptor to the intermediate transfer belt can be enabled to transfer the patch. For example, the residual marking material cleaning stress patch can be transferred from the photoreceptor to the intermediate transfer belt after cleaning the marking material cleaning stress patch on the photoreceptor. One or more residual marking material cleaning stress patches can be transferred from the photoreceptor to the intermediate transfer belt. For example, a first residual marking material cleaning stress patch can be transferred to a single document panel on the intermediate transfer belt and a second residual marking material cleaning stress patch can be transferred to the single document panel on the intermediate transfer belt. Different residual marking material cleaning stress patches can also be transferred to different document panels on the intermediate transfer belt.

At 328, the transferred residual marking material cleaning stress patch can be scanned, sensed, and/or read using an intermediate transfer belt sensor, such as an optical array sensor. At 330, whether there is measurable marking material, such as toner, from the residual marking material cleaning stress patch on the intermediate transfer belt can be determined based on the reading from the intermediate transfer belt sensor. For example, it can be determined whether the transferred marking material cleaning stress patch on the intermediate transfer belt has an amount of transferred marking material greater than a threshold amount of marking material based on sensing the transferred marking material cleaning stress patch. If there is no measurable marking material on the intermediate transfer belt, at 332, normal printing operation can be resumed.

If there is measurable marking material on the intermediate transfer belt, at 334 whether an amount of marking material, such as toner, from the residual marking material cleaning stress patch on the intermediate transfer belt is greater than a threshold can be determined. For example, it can be determined whether the transferred marking material cleaning stress patch on the intermediate transfer belt has an amount of transferred marking material greater than a threshold amount of marking material based on sensing the transferred marking material cleaning stress patch. If the amount of marking material is greater than the threshold, at 336, a signal can be output to provide instructions to replace or adjust the photoreceptor cleaner. For example, a user can be informed to replace a failed cleaning blade. As a further example, a signal can be output that indicates the photoreceptor cleaner will require adjustment if the amount of transferred marking material on the intermediate transfer belt is greater than the threshold amount of marking material.

If the amount of marking material is less than the threshold, at 338, a time until photoreceptor cleaner failure can be predicted based on the sensed transferred residual marking material stress patch. If failure is predicted before a next service call for servicing the printing apparatus at 340, the method can advance to block 336. If failure is not predicted before the next service call at 340, at 342, service can be scheduled for replacement or adjustment of the photoreceptor cleaner, such as replacement of a failed cleaning blade. For example, a signal can be output that indicates the photoreceptor cleaner will require adjustment if the amount of transferred marking material on the intermediate transfer belt is greater than the threshold amount of marking material.

According to some embodiments, all of the blocks of the flowchart 300 are not necessary. Additionally, the flowchart 300 or blocks of the flowchart 300 may be performed numerous times, such as iteratively. For example, the flowchart 300 may loop back from later blocks to earlier blocks. Furthermore, many of the blocks can be performed concurrently or in parallel processes.

The flowchart 300 can illustrate steps of a blade stress test to evaluate cleaning function for a single color photoreceptor cleaning blade. The same process can be used for all colors with the stress patch development timed to put all of them on the same intermediate transfer belt print pitch for minimum printing disruption. The example shown for blade replacement or scheduled service based on the amount of toner detected on the blade cleaning stress patch may be modified for the case of four or more blades. The replacement of all blades may be bundled if there is a replacement service cost advantage to doing so.

Prediction of the time to cleaning blade failure can be based on successive measurements of the amount of toner allowed past the blade if there are enough readings prior to reaching the failure threshold level for a confident prediction. Experience with tape transfers of toner past the cleaning blade has demonstrated that typically there are detectable amounts of toner on the photoreceptor long before a print failure is detectable. According to one experiment, the amount of toner on the photoreceptor surface that was declared a cleaning failure occurred at half the number of prints to generate a failure on a print. The failure threshold amount of toner can be based on contamination rates caused by toner past the blade rather than print defects directly due to toner past the blade. As an example, charge device contamination due to toner passing under the blade may cause poor print quality sooner than streaks on the prints directly due to the toner that was not cleaned.

Optical array sensing of toner past the cleaner is capable of detecting failures anywhere along the length of the blade. This can be used because the blade does not wear uniformly and the blade does not fail across its full length all at once. By periodic monitoring of the blade edge condition using an optical array sensor, blades with early failures can be detected and replaced and blades that are wearing at a slow rate can be continued in use until failure. The distribution of blade lives predicted from blade wear rate measurements shows that the majority of blades can last a very long time. A long tail to very short lives has traditionally required that blades be replaced well before their potential life has been reached. It is common to replace components when 10% of the population has failed. By incorporating a blade edge condition monitoring system, average blade life can be greatly extended and reliability can be increased by avoiding expensive unscheduled maintenance calls.

Figure 4:
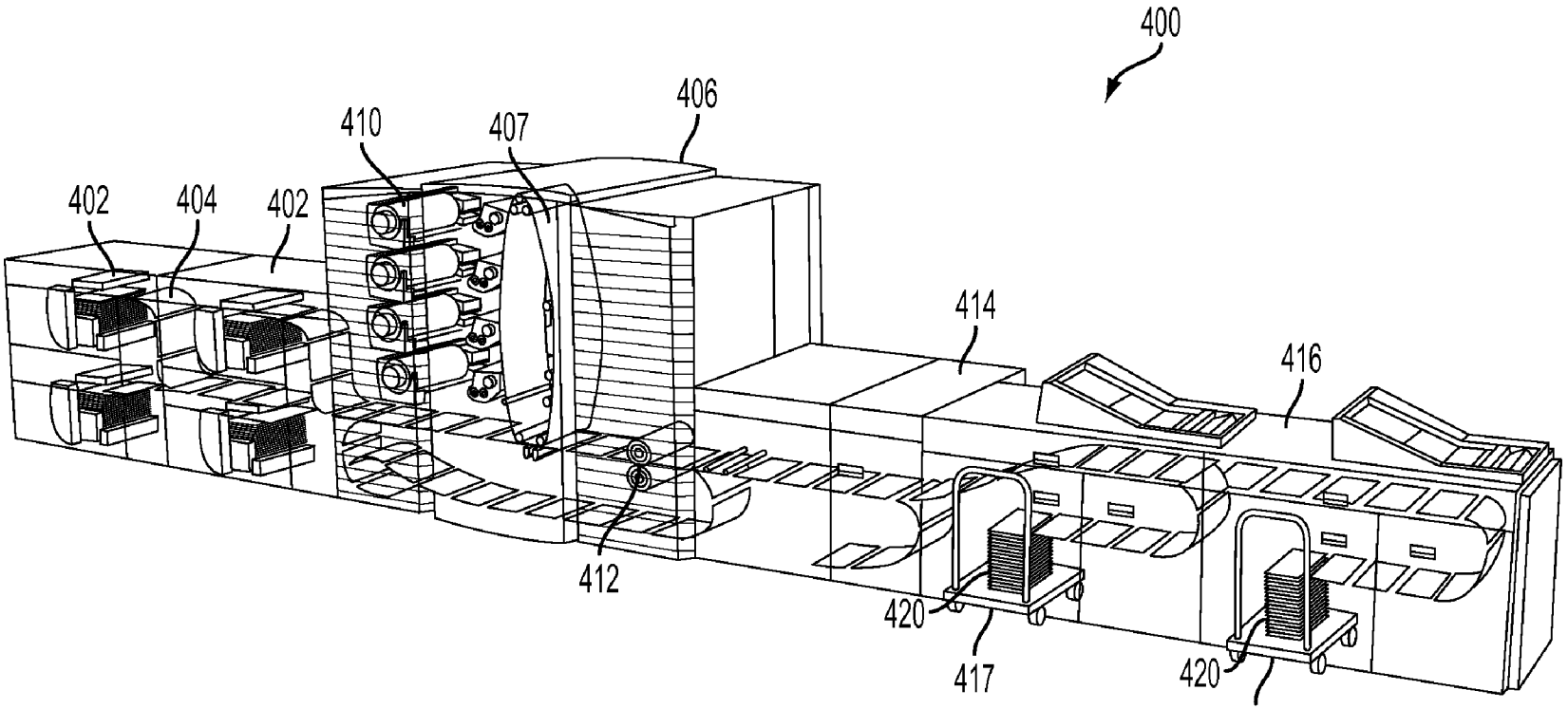
FIG. 4 illustrates an exemplary printing apparatus.

FIG. 4 illustrates an exemplary printing apparatus 400, such as the printing apparatus 100. As used herein, the term "printing apparatus" encompasses any apparatus, such as a digital copier, bookmaking machine, multifunction machine, and other printing devices that perform a print outputting function for any purpose. The printing apparatus 400 can be used to produce prints from various media, such as coated, uncoated, previously marked, or plain paper sheets. The media can have various sizes and weights. In some embodiments, the printing apparatus 400 can have a modular construction. As shown, the printing apparatus 400 can include at least one media feeder module 402, a printer module 406 adjacent the media feeder module 402, an inverter module 414 adjacent the printer module 406, and at least one stacker module 416 adjacent the inverter module 414.

In the printing apparatus 400, the media feeder module 402 can be adapted to feed media 404 having various sizes, widths, lengths, and weights to the printer module 406. In the printer module 406, toner is transferred from an arrangement of developer stations 410 to a charged photoreceptor belt 407 to form toner images on the photoreceptor belt 407. The photoreceptor belt 407 can be the photoreceptor 110 or the intermediate transfer belt 150. The toner images are transferred to the media 404 fed through a paper path. The media 404 are advanced through a fuser 412 adapted to fuse the toner images on the media 404. The inverter module 414 manipulates the media 404 exiting the printer module 406 by either passing the media 404 through to the stacker module 416, or by inverting and returning the media 404 to the printer module 406. In the stacker module 416, printed media are loaded onto stacker carts 417 to form stacks 420.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A method in a printing apparatus including a photoreceptor, a developer, a photoreceptor cleaner, an intermediate transfer belt, and an intermediate transfer belt sensor, the method comprising:

placing marking material on the photoreceptor using the developer;

cleaning the marking material on the photoreceptor using the photoreceptor cleaner to produce residual marking material;

transferring the residual marking material to the intermediate transfer belt; and sensing the transferred marking material on the intermediate transfer belt using the intermediate transfer belt sensor.

2. The method according to claim 1, further comprising substantially disabling transfer of the marking material from the photoreceptor to the intermediate transfer belt after placing the marking material on the photoreceptor and before cleaning the marking material on the photoreceptor.

3. The method according to claim 1, further comprising minimizing interaction with the residual marking material prior to transferring the residual marking material to the intermediate transfer belt.

4. The method according to claim 3, wherein minimizing comprises:

substantially disabling a development alternating current bias as the residual marking material passes under the developer; and setting a development direct current bias to minimize development of the residual marking material.

5. The method according to claim 3, wherein minimizing comprises:

sensing a voltage on the photoreceptor after cleaning the marking material; and setting a development direct current bias to substantially an average of a background potential on the photoreceptor and a residual marking material potential on the photoreceptor as the residual marking material passes under the developer.

6. The method according to claim 1, further comprising, rotating the photoreceptor in a process direction to move the marking material on the photoreceptor past the intermediate transfer belt after the marking material is placed on the photoreceptor, wherein cleaning the marking material on the photoreceptor is performed after the marking material on the photoreceptor is moved past the intermediate transfer belt, and wherein transferring the residual marking material is performed after cleaning the marking material on the photoreceptor.

7. The method according to claim 6, wherein the printing apparatus includes a charge device configured to charge the photoreceptor, and wherein the method further comprises substantially disabling charging the photoreceptor while the residual marking material passes under the charge device and disabling development on the photoreceptor prior to transferring the residual marking material.

8. The method according to claim 1, wherein developing comprises developing a first marking material cleaning stress patch on a first photoreceptor and developing a second marking material cleaning stress patch on a second photoreceptor.

9. The method according to claim 8, wherein transferring comprises transferring a first residual marking material cleaning stress patch to a single document panel on the intermediate transfer belt and transferring a second residual marking material cleaning stress patch to the single document panel on the intermediate transfer belt.

10. The method according to claim 8, wherein the first marking material cleaning stress patch is of a first color and the second marking material cleaning stress patch is of a second color different from the first color.

11. The method according to claim 1, further comprising:

determining the transferred marking material on the intermediate transfer belt has an amount of transferred marking material greater than a threshold amount of marking material based on sensing the transferred marking material; and outputting a signal that the photoreceptor cleaner will require adjustment if the amount of transferred marking material on the intermediate transfer belt is greater than the threshold amount of marking material.

12. A printing apparatus comprising:

a photoreceptor;

an intermediate transfer belt configured to receive marking material from the photoreceptor;

a developer configured to place marking material on the photoreceptor;

a photoreceptor cleaner configured to clean the marking material on the photoreceptor to produce residual marking material;

a transfer station configured to transfer the residual marking material to the intermediate transfer belt; and an intermediate transfer belt sensor configured to sense the transferred marking material on the intermediate transfer belt.

13. The printing apparatus according to claim 12, wherein the photoreceptor is configured to rotate in a process direction to move the marking material on the photoreceptor past the intermediate transfer belt after the marking material is placed on the photoreceptor, wherein the photoreceptor cleaner is configured to clean the marking material on the photoreceptor after the marking material on the photoreceptor is moved past the intermediate transfer belt, and wherein the transfer station is configured to transfer the residual marking material after the photoreceptor cleaner cleans the marking material on the photoreceptor.

14. The printing apparatus according to claim 12, further comprising a printing apparatus controller configured to substantially disable transfer of the marking material from the photoreceptor to the intermediate transfer belt after the developer places the marking material on the photoreceptor and before the photoreceptor cleaner cleans the marking material on the photoreceptor.

15. The printing apparatus according to claim 12, further comprising a printing apparatus controller configured to minimize interaction with the residual marking material prior to transferring the residual marking material to the intermediate transfer belt.

16. The printing apparatus according to claim 12, further comprising:

a charge device configured to charge the photoreceptor; and a printing apparatus controller configured to substantially disable charging the photoreceptor while the residual marking material passes under the charge device and disable development on the photoreceptor prior to transferring the residual marking material.

17. The printing apparatus according to claim 12, wherein the photoreceptor comprises a first photoreceptor, wherein the developer comprises a first developer configured to develop a first marking material cleaning stress patch on the first photoreceptor, and wherein the printing apparatus comprises:

a second photoreceptor; and a second developer configured to develop a second marking material cleaning stress patch on the second photoreceptor.

18. The printing apparatus according to claim 12, further comprising a printing apparatus controller configured to determine the transferred marking material on the intermediate transfer belt has an amount of transferred marking material greater than a threshold amount of marking material based on sensing the transferred marking material and configured to output a signal indicating that the photoreceptor cleaner will require adjustment if the amount of transferred marking material on the intermediate transfer belt is greater than the threshold amount of marking material.

19. A method in a printing apparatus including an intermediate transfer belt, an intermediate transfer belt sensor, a developer, a photoreceptor, and a photoreceptor cleaner, the method comprising:

placing marking material on the photoreceptor using the developer;

substantially disabling transfer of the marking material from the photoreceptor to the intermediate transfer belt after placing the marking material on the photoreceptor;

rotating the photoreceptor in a process direction to move the marking material on the photoreceptor past the intermediate transfer belt after disabling transfer of the marking material from the photoreceptor to the intermediate transfer belt;

cleaning the marking material on the photoreceptor using the photoreceptor cleaner to produce residual marking material after moving the marking material on the photoreceptor past the intermediate transfer belt;

transferring the residual marking material to the intermediate transfer belt; and sensing the transferred marking material on the intermediate transfer belt using the intermediate transfer belt sensor.

20. The method according to claim 19, further comprising:

substantially disabling a development alternating current bias as the residual marking material passes under the developer; and setting a development direct current bias to minimize development of the residual marking material.

21. A method in a printing apparatus including a photoreceptor, an intermediate transfer belt, an intermediate transfer belt cleaner, and an intermediate transfer belt sensor, the method comprising:

placing marking material on the photoreceptor;

transferring the marking material from the photoreceptor to the intermediate transfer belt to produce transferred marking material on the intermediate transfer belt;

substantially disabling transfer of the transferred marking material from the intermediate transfer belt after transferring the marking material from the photoreceptor to the intermediate transfer belt and before cleaning the transferred marking material on the intermediate transfer belt;

cleaning the transferred marking material on the intermediate transfer belt using the intermediate transfer belt cleaner to produce residual marking material on the intermediate transfer belt;

sensing the residual marking material on the intermediate transfer belt using the intermediate transfer belt sensor.

22. The method according to claim 21, further comprising minimizing interaction with the residual marking material after cleaning the transferred marking material and prior to sensing the residual marking material.

23. The method according to claim 21, wherein substantially disabling transfer comprises substantially disabling transfer of the transferred marking material from the intermediate transfer belt to media after transferring the marking material from the photoreceptor to the intermediate transfer belt and before cleaning the marking material cleaning stress patch on the photoreceptor.

24. The method according to claim 21, wherein the printing apparatus comprises a media transfer station configured to transfer marking material from the intermediate transfer belt to media, wherein substantially disabling transfer comprises substantially disabling transfer of the transferred marking material from the intermediate transfer belt to media at the media transfer station after transferring the marking material from the photoreceptor to the intermediate transfer belt and before cleaning the marking material on the intermediate transfer belt, and wherein the method comprises running the transferred marking material on the intermediate transfer belt past the media transfer station after substantially disabling transfer of the transferred marking material from the intermediate transfer belt.

25. The method according to claim 24, wherein the marking material is first transferred from the photoreceptor to the intermediate transfer belt at a photoreceptor transfer station, then passes the disabled media transfer station, then is cleaned by the intermediate transfer belt cleaner, then is sensed by the intermediate transfer belt sensor.

26. The method according to claim 25, wherein the residual marking material passes the photoreceptor transfer station after being cleaned by the intermediate transfer belt cleaner and before being sensed by the intermediate transfer belt sensor.

27. The method according to claim 21, wherein the intermediate transfer belt cleaner comprises an intermediate transfer belt cleaning blade.

28. The method according to claim 21, wherein the intermediate transfer belt sensor comprises an optical array sensor.

29. The method according to claim 21, further comprising:

determining the residual marking material on the intermediate transfer belt has an amount of marking material greater than a threshold amount of marking material based on sensing the residual marking material; and outputting a signal that the intermediate transfer belt cleaner will require adjustment if the amount of residual marking material on the intermediate transfer belt is greater than the threshold amount of marking material.

30. A printing apparatus comprising:

a photoreceptor;

a developer configured to place marking material on the photoreceptor;

an intermediate transfer belt configured to receive marking material transferred from the photoreceptor;

a media transfer station configured to transfer marking material from the intermediate transfer belt to media;

an intermediate transfer belt cleaner configured to clean the transferred marking material on the intermediate transfer belt to produce residual marking material on the intermediate transfer belt;

a controller configured to substantially disable transfer of the transferred marking material from the intermediate transfer belt after transferring the marking material from the photoreceptor to the intermediate transfer belt and before cleaning the marking material on the intermediate transfer belt;

an intermediate transfer belt sensor configured to sense the residual marking material on the intermediate transfer belt.

31. The printing apparatus according to claim 30, wherein the controller is configured to minimize interaction with the residual marking material after the intermediate transfer belt cleaner cleans the transferred marking material and prior to the intermediate transfer belt sensor sensing the residual marking material.

32. The printing apparatus according to claim 30, wherein the controller is configured to substantially disable transfer by substantially disabling transfer of the transferred marking material from the intermediate transfer belt to media after transferring the marking material from the photoreceptor to the intermediate transfer belt and before cleaning the marking material on the intermediate transfer belt.

33. The printing apparatus according to claim 30, wherein the controller is configured to substantially disable transfer by substantially disabling transfer of the transferred marking material from the intermediate transfer belt to media at the media transfer station after transferring the marking material from the photoreceptor to the intermediate transfer belt and before cleaning the transferred marking material on the intermediate transfer belt, and wherein the transferred marking material on the intermediate transfer belt passes the media transfer station after substantially disabling transfer of the transferred marking material from the intermediate transfer belt.

34. The printing apparatus according to claim 33, wherein the marking material is first transferred from the photoreceptor to the intermediate transfer belt at a photoreceptor transfer station, then passes the disabled media transfer station, then is cleaned by the intermediate transfer belt cleaner, then is sensed by the intermediate transfer belt sensor.

35. The printing apparatus according to claim 34, wherein the residual marking material passes the photoreceptor transfer station after being cleaned by the intermediate transfer belt cleaner and before being sensed by the intermediate transfer belt sensor.

36. The printing apparatus according to claim 30, wherein the intermediate transfer belt cleaner comprises an intermediate transfer belt cleaning blade.

37. The printing apparatus according to claim 30, wherein the intermediate transfer belt sensor comprises an optical array sensor.

38. The printing apparatus according to claim 30, wherein the controller is configured to determine the residual marking material on the intermediate transfer belt has an amount of marking material greater than a threshold amount of marking material based on sensing the residual marking material and is configured to output a signal that the intermediate transfer belt cleaner will require adjustment if the amount of residual marking material on the intermediate transfer belt is greater than the threshold amount of marking material.

* * * * *